US006606947B2

(12) United States Patent
Frossard et al.

(10) Patent No.: US 6,606,947 B2
(45) Date of Patent: Aug. 19, 2003

(54) DEVICE FOR PROCESSING PRINTING DEFECTS DETECTED IN A PRINTING MACHINE

(75) Inventors: Daniel Frossard, Lausanne (CH); Nathan Stern, Bussigny (CH)

(73) Assignee: Bobst S.A. (CH)

( * ) Notice: Subject to any disclaimer, the term of this patent is extended or adjusted under 35 U.S.C. 154(b) by 0 days.

(21) Appl. No.: 09/853,965

(22) Filed: May 11, 2001

(65) Prior Publication Data

US 2001/0039892 A1 Nov. 15, 2001

(30) Foreign Application Priority Data

May 11, 2000 (CH) ..... 0926/00

(51) Int. Cl.[7] ..... B41L 5/12

(52) U.S. Cl. ..... 101/484; 101/171

(58) Field of Search ..... 101/484, 483, 101/171; 382/181, 190, 195

(56) References Cited

U.S. PATENT DOCUMENTS 6,112,658 A * 9/2000 Gunther et al. ..... 101/171

* cited by examiner

*Primary Examiner*—Charles H. Nolan, Jr.
(74) *Attorney, Agent, or Firm*—Ostrolenk, Faber, Gerb & Soffen, LLP

(57) ABSTRACT

A device for processing of printing defects detected in a printing machine which in a first phase delivers a printed support. The printing defects (20, 21, 22) on the support (1) are detected in a detection station. A database connected to the detection station can simultaneously store information relating to each detected printing defect. The processing device connected to the database can, in a second phase, process the stored information in order to evaluate the quality of overall printing of the printed support and can use various possible scenarios, even before the support (1) is cut in a third phase, to define all those portions (23) of the support which should be removed in order to improve the final quality of the printed product within the limit of a restriction in the number of portions which it has been agreed to cut out.

20 Claims, 3 Drawing Sheets

DEVICE FOR PROCESSING PRINTING DEFECTS DETECTED IN A PRINTING MACHINE

The invention relates to a device for processing of printing defects detected in a printing machine delivering a printed product for the packaging industry starting from a support such as sheets or continuous webs of paper, cardboard or another flexible material such as polyethylene.

The invention mainly relates to a decision aid for inter alia displaying, e.g. in schematic, tabular or image form, an entire support such as a web with all the faults which spoil it and have previously been detected by a conventional device. By means of various virtual filters, the decision aid can display a number of cases of patterns or designs representing the quality level of the web and can in each case number and locate all portions of web which are covered with excessively marked defects and must be removed, even before irremediably cutting out the defects and ejecting them from the web.

Flexible packaging, made specifically from web material, is produced in various successive phases during which the reels must be repeatedly unwound and wound in order to print the web and the pack the products for which the packaging is intended.

A first step begins with printing the web, starting from a virgin reel having a width which can usually contain a number of generally identical packaging imprints. The number of imprints thus disposed side by side across the width of the web defines the number of tracks in the web. Once printed, the web is dried and examined by a device for detecting, recognising and recording all the kinds of printing defects which it may prevent. These defects are located in a Cartesian system and stored by the detection and locating device, which registers their position with respect to an origin in the longitudinal direction and with respect to the various tracks occupied in the transverse direction. Some devices can detect "nascent" defects, resulting generally from wear or a drift of one component of the rotary press and inevitably increasing as the printing proceeds. Any defect found will require intervention by the machine operator, who will mark the approximate place where the fault was detected by placing a sticker (cardboard tab) on the web so that when the web is rewound, the sticker projects slightly from its edge and is easily detectable. Intervention may alternatively be via an automatic labelling machine. If necessary, the machine operator may even have to stop printing in order to eliminate the possible cause of a nascent defect before it becomes unacceptable. After being inspected, the printed web is rewound in the case of machines which deliver a product in reels, as opposed to products presented in sheet form.

The second step in the conventional process consists in taking the printed reel and cutting it longitudinally to form a number of small reels equal to the number of tracks on the web. To this end, the printed web is again progressively unrolled and inserted into a rotary cutter which divides it longitudinally along a line defined by the boundaries of the tracks therein. During the web unwinding phase, the operator must attentively look out for the approach of all the stickers previously attached to the web. On arrival of each sticker the web must be stopped and the operator will have to find the detected fault and see where it begins and where it ends before eliminating it by two transverse cuts in the tracks in question. After the defective portion has been removed, the appropriate ends of the tracks are stuck together, e.g. with sticky tape. The tracks are then all simultaneously re-wound before being delivered in the form of independent reels to the customer, who will pack his products by again unrolling each small reel in a third and final step.

The invention is of use mainly in the second step, before the conversion of the printed reel begins. Devices for detecting printing errors are already known, such as those previously mentioned and illustrated in patents EP 452 769 and EP 554 811, where cameras and monitor screens are used to display faults appearing in a web or on material in sheet form during printing.

The printed webs can either serve as base material for machines producing packaging in the form of sheets, or can be re-worked and re-stored in the form of smaller reels for packing products in packaging taken off rolls. The first kind of products are very easy to manipulate, more particularly as regards removing and ejecting all defective articles from the production line, though of course it is not so easy to perform this operation on products stored in the form of continuous webs. In the case where the packaging end product is a continuous web stored on a reel, it is difficult and much more expensive to eliminate all parts of the web which have been judged defective. During the first step, elimination of such portions will necessitate a complete stoppage of the printing machine, which will seriously affect the production rate and may cause other problems in subsequent printing during the always difficult phase of restarting the rotary press. Elimination of the defective portions during the second step will result in the same problems, in this case with the rotary cutter. This machine, however, has the advantage of being simpler in construction and less fragile and of not presenting any special risk to the web when the web has to follow repeated successive stops and starts.

The number of joins in the final reel, however, will largely affect the estimate of its quality and of course consequently affect its selling price. For technical reasons which can easily be checked, it is found that joins in webs regularly pose problems in the product-packing machines which constitute the third step in the use of these reels. In view of these problems, many customers make it a general rule that these reels should not contain more than two or three joins, notwithstanding any residual printing faults which they may contain.

No device known hitherto can display the state of the web in its entirety together with its defects in order to process them in the a priori limitless cases which may occur. Each case represents a certain modulation in the degree of tolerance of these defects, so as to optimise production and obtain the best possible compromise between the maximum number of joins permitted by the customer and the number of residual defects which can still be considered as admissible.

The object of the invention therefore is to provide a tool for overall evaluation of the quality of printing of the web and for defining, using various possible scenarios and before irremediable cutting, all those portions which it is considered appropriate to reject as a priority, starting from the maximum number of web joins permitted by the customer.

This object is achieved by a device comprised of a defect detection station including an imaging device positioned to inspect the printed product as it moves along a travel path and a first data processing unit which is programmed to generate data representing individual printing defects in the printed product from signals generated by the imaging device, data representing the location of the printing defects in terms of a Cartesian reference system applying to the support layer and to record the generated printing defect data in a database that is capable of simultaneously storing data relating to all of the detected printing defects in the printed product. The device is further comprised of a defect processing station including a second data processing unit programmed to be responsive to data representing all of the defects in the printed product stored in the data base and to at least one quality-defining criterion to evaluate the quality of overall printing of the printed product and to generate finishing instructions for selecting those defective portions of the printed product to be removed to obtain a desired final quality level for the printed product and further includes a device that executes the finishing instructions generated by the second data processing unit.

The invention will be more clearly understood by studying a completely non-limitative embodiment illustrated by the accompanying drawings in which.

Figure 1:
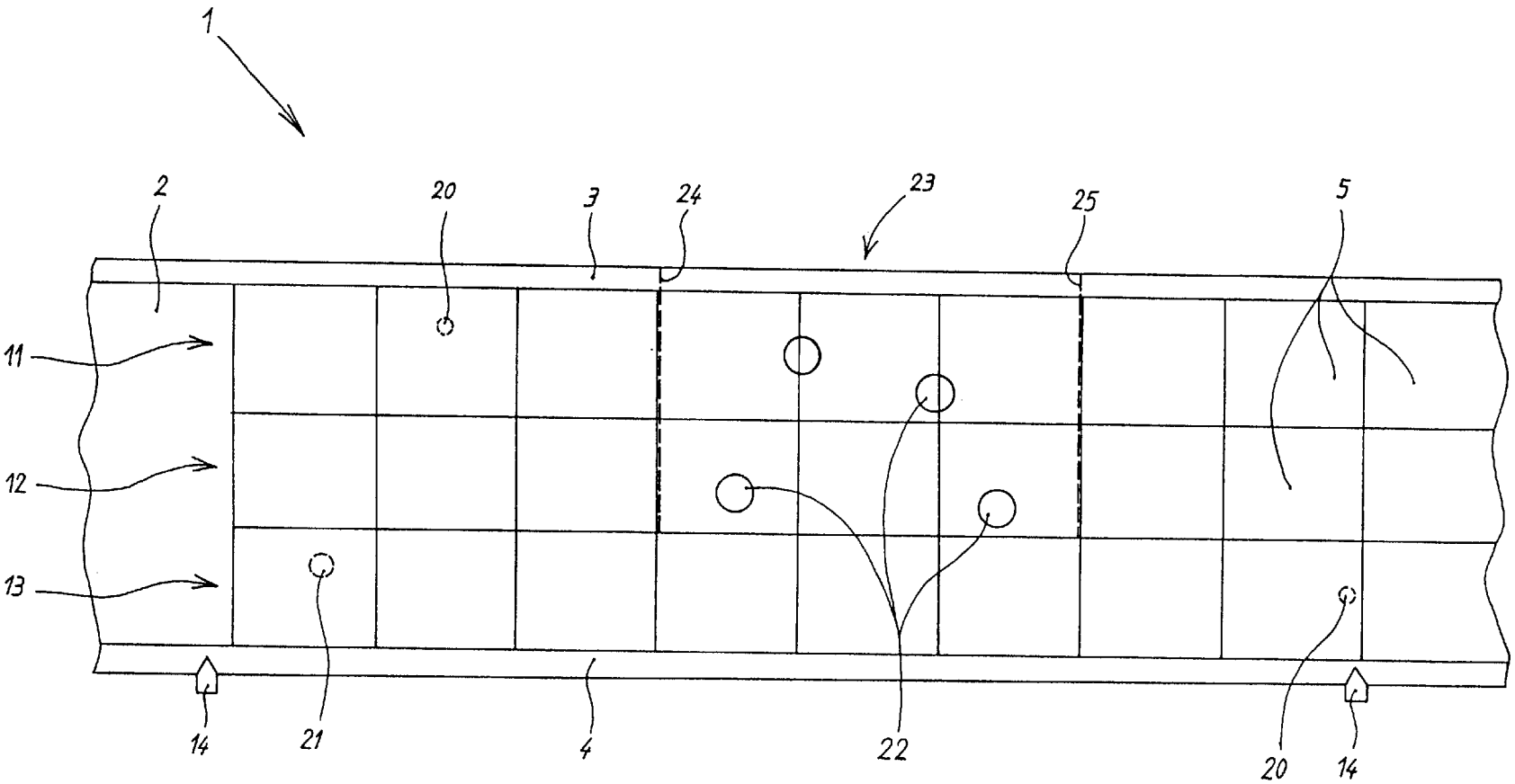
FIG. 1 is a diagrammatic representation of the state of a part of a printed web.

FIG. 1 diagrammatically shows the state of part of a web 1 from a rotary printing machine. The web comprises a trailer 2 in the downstream part and two marginal strips 3, 4 between which a mosaic of patterns 5 is printed, the patterns being left by the printing cylinder of the rotary machine. The printed patterns may or may not be identical but each pattern by itself will be converted into packaging after the final production step. The patterns 5 are carefully aligned and, in the case shown, form three distinct tracks 11, 12, 13. Reference markers 14 such as self-adhesive tabs are attached to one or the other marginal strip 3, 4 at precisely regular intervals. The drawing diagrammatically shows various printing defects 20, 21, 22. The defects differ in their degree of importance, which is low in the case of tolerated printing defects 20, average for borderline printing defects 21 and high for unacceptable printing defects 22. A number of unacceptable defects 22 coming together will therefore justify the choice of a portion of the web 23 which it would be desirable to remove by a downstream cross-cut 24 and an upstream cross-cut 25. Notice that the said web portion 23 need not contain all the tracks 11, 12, 13; only the faulty tracks need to be cut out (skilfully) by cross-cuts 24 and 25.

Figure 2:
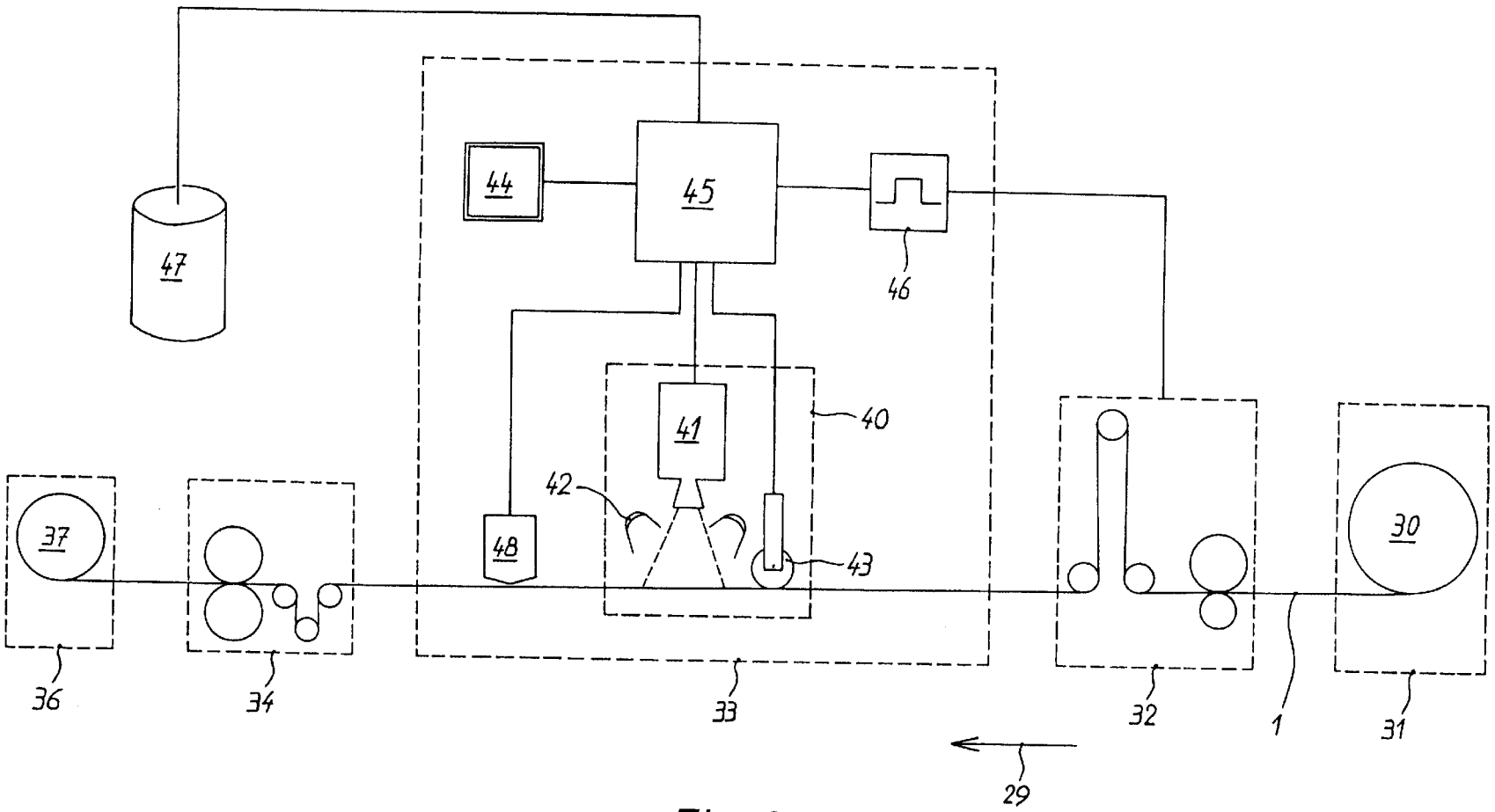
FIG. 2 is a diagrammatic representation of the main components operating in the web printing phase as known at present.

FIG. 2 is a diagrammatic representation of the main components operative in the phase for printing the web 1, the phase which constitutes the first step in the packaging production process. Starting from a virgin reel 30, generally sufficiently wide to contain a number of imprints or printing patterns 5, the continuous web 1 moves downstream in the direction represented by arrow 29. The continuous web successively passes through various stations, the commonest being an insertion station 31 from which the web comes out, one or more printing and drying stations 32, a station 33 for detecting and locating printing defects, a traction station or group 34 for stretching the web and for compensating fluctuations in tension by using a sliding gear, and finally a reception station 36 in which the continuous web 1 is stored in the form of a printed reel 37.

During the printing phase, it may happen that the web 1 acquires various printing defects 20, 21, 22 such as absence, excess or spraying of ink, spots of oil from a part of the machine, or defective adjustment or reference marking resulting in shifts between the printing of the base colours of the printed pattern. Other more gradual and more easily detectable printing defects are called "nascent" and indicate progressive deterioration due to normal wear of one or more components of the printing machine such as the ink scraper, the printing member or the back-up impression cylinder. Although initially within the tolerated limit, these defects develop and increase during printing until they become excessive and unacceptable.

In order to detect all these defects, the web 1 after being printed travels through a scanning unit 40 comprising at least one camera 41 having a field of vision made clearly visible by a lighting device 42, and a measuring instrument 43 for synchronising the image acquisition with the advance of the web. The camera 41 is connected to a control unit 45 which takes account of the defects and is connected to a monitor 44 for displaying them. A pulse generator 46 shown in the diagram connects the printing and drying station 32 to the control unit 45. The pulse generator constitutes the clock of the station 33 for detection and location of defects. Depending on the rate of printing, it can compensate errors in reference marking resulting mainly from normal variations in the tension and length of the web and consequently distorting the rigour of the information transmitted by the measuring instrument 43. The instrument 43 consists simply of a rubber-coated roller which, without slipping, enters into permanent contact with the belt 1 and delivers e.g. between 1000 and 2000 pulses during each rotation of the roller. The pulses from the generator 26 are transmitted to the control unit 45, which combines them with the pulses delivered by the measuring instrument 43 so as to mark the abscissa at which a defect 20, 21, 22 has been detected, along a longitudinal virtual axis representing the length of the web 1. The camera 41 can detect the track 11, 12 or 13 where the defects occur.

The control unit 45 is thus capable of locating, along two perpendicular axes, the position of the defects 20, 21, 22 on the web and classifying them e.g. in accordance with their characteristics and the frequency with which they occur. All this information is stored in a database 47 connected to the control unit 45. The origin of the longitudinal axis used for locating all the printing faults is indicated by the first reference marker 14 attached by a marking device 48 to the marginal strip 3, 4 of the web 1. In order to limit systematic errors and improve the accuracy of location of defects, a number of markers 14 are attached to the web 1 at exactly regular intervals. The reference markers 14 will each constitute a new origin which will be taken as a reference in the second step of processing the web 1. The device 48 can e.g. be a labelling machine controlled by the control unit 45 in dependence on pulses received both by the measuring instrument 43 and by the pulse generator 46.

Figure 3:
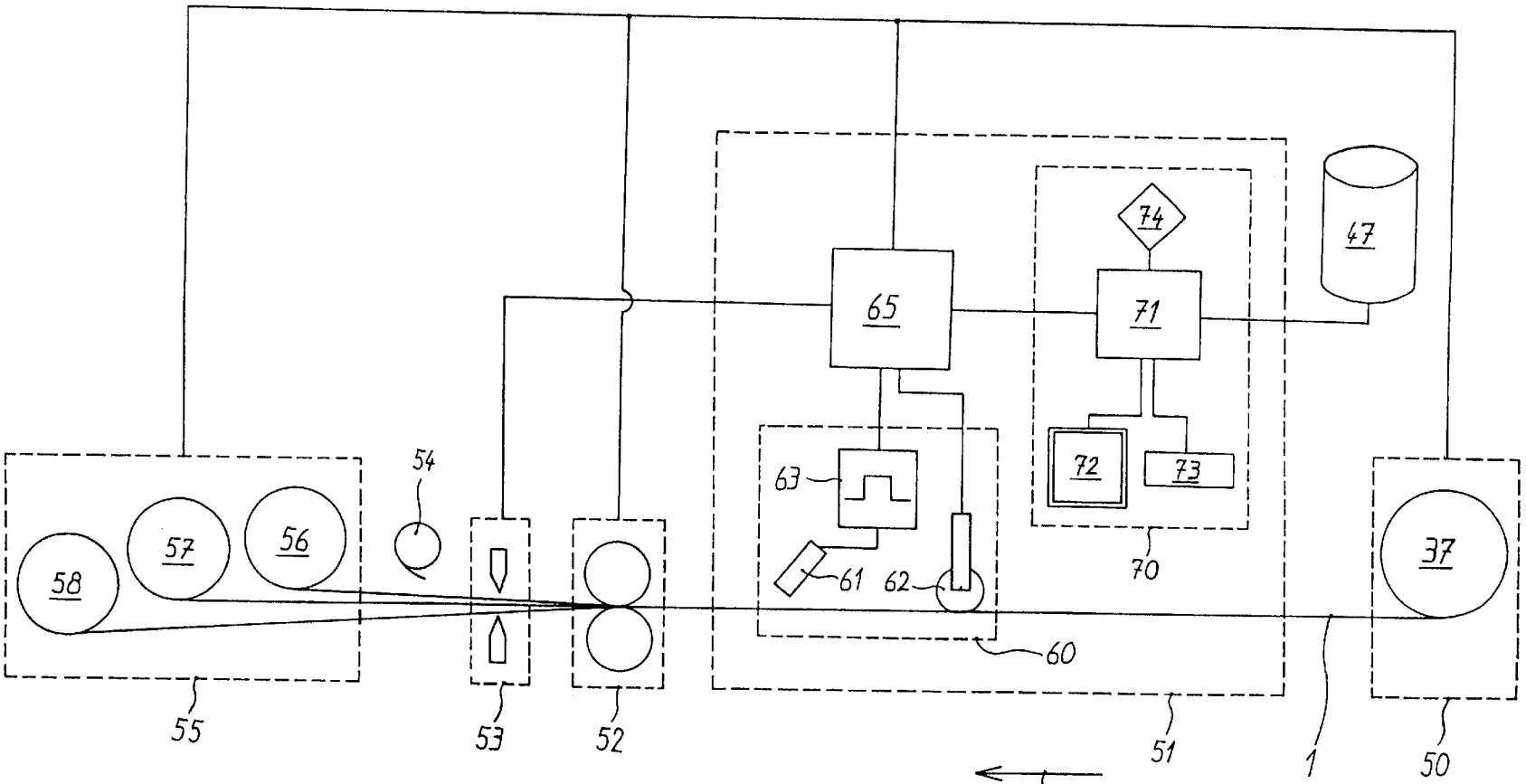
FIG. 3 is a diagrammatic representation of the various components operative in the phase of processing of defects and cutting the web.

FIG. 3 is a diagrammatic representation of the various components operating in the phase of cutting the web 1, a phase which constitutes the second step in the process of producing packaging as previously described. The printed web 37 coming from the reception station 43 is placed in a new insertion station 50. The station 50 is upstream of a second production line for successively processing, according to the invention, all the data relating to the printing defects 20, 21, 22 previously stored, then cutting the printed web 1 in accordance with the best compromise evaluated by a fault processing device 51. The device can also control all the operations of cutting the web 1, which are mostly effected in the direction of advance 29, using the rotary cutting edges in a longitudinal cutting station 52, and occasionally perpendicular to the direction of advance 29, using a cross-cutting device 53. During longitudinal cutting the tracks 11, 12, 13 are separated and the marginal strips 3, 4 of the web are eliminated, now independent, the tracks will finally be wound a last time in a second reception station 55 to form narrower reels 56, 57, 58 constituting the end product from this production line. Of course the number of reels will directly depend on the number of tracks contained by the web when printed.

In the embodiment of the invention, the printing fault processing device 51 comprises a scanning unit 60 connected to a processing unit 65 and a stored-data processing interface 70 situated between the database 47 and the processing unit 65. The scanning unit 60 comprises two scanning means, i.e. a detector 61 of reference markers 14 and a second measuring instrument 62 serving the same purpose as the corresponding instrument 43 described previously. The detector 61 brings the marking of defects back into synchronism with the sometimes unsteady advance of the web, after detection of the reference markers 14 previously defined as perfectly-known fixed origins. The measuring instrument 62 is directly connected to the processing unit 65 whereas the detector 61 is indirectly connected via a second pulse generator 63. The generator 63 provides a digital synchronisation pip at each passage of a reference marker 14.

The processing unit 65 is the control component of the printing-defect processing assembly 51. It controls the advance and the longitudinal cutting of the web 1 by acting on the common drive of the insertion station 50, the longitudinal cutting station 52 and the reception station 55, and also controls the cutting edge of the transverse cutting station 53 in the case where the said station is automated. The processing unit 65 controls the operation of all these components in dependence on information obtained about the processed faults at the data-processing interface 70. The interface comprises a processing unit 71 comparable with a computer console. The machine operator uses the interface 70 to process and handle all information previously collected in the database 47 connected to the processing unit 71. The interactive dialogue between the machine operator and the processing unit 71 takes place via an output peripheral 72 such as a monitor and an input peripheral 73 such as a keyboard, a mouse or the tactile part of a screen. The processing unit 71 is also connected to a bank of filters 74, the use of which will be described hereinafter. The interface 70, which is made up of units forming a standard data-processing station, may advantageously be disposed away from the production line, e.g. in a monitoring room insulated from noise.

The device 51 for processing printing defects operates as follows. The processing unit 71, which has access to all information describing inter alia the type, importance and location of each classified defect 20, 21 and 22, is capable of returning all this information to the operator who can then display it on the monitor 72. The information may be presented in image or table form or, as in FIG. 1, in a diagrammatic form which is more illustrative but still corresponds to the actual state of the web stored on the printed reel 37. The unit 71 for processing information recorded in the database 47 can supply additional events derived from statistics for the total length of the web. This combination of information has numerous advantages of use e.g. for quantifying the overall printing quality of the web, displaying all the critical zones where printing is found to be of poor quality, and simulating various cutting scenarios in dependence on the use of a certain number of virtual filters which mask defects considered as less important.

To this end, the operator can have access to various information tools for producing the said virtual filters and storing them as required in the filter bank 74. The virtual filters are usually in the form of a list of alphanumeric instructions decodable by a data-processing system. They contain all conditions which can exclude revelation of defects defined as secondary under the chosen criterion. One or more filters applied to the data representing the printing faults 20, 21, 22 can best define the ideal positions of the cross-cuts 24, 25 authorised in limited numbers by the customer. With the knowledge of the entire history of printing the reel 37, therefore, the operator will be in possession of a decision aid enabling him to optimise the final quality of the reel. Note that the production and choice of the most suitable filters can be defined manually or chosen automatically e.g. by using a search algorithm.

Once the final configuration of the cross-cuts 24, 25 has been chosen, the printed reel 37 can begin to unwind and the process of converting the reel can begin. The web 1 first advances under the measuring instrument 62 which counts its length relative to the origin of the longitudinal marking system as soon as the web has been recognised by the detector 61. The origin is first defined by the first reference marker 14 encountered, then successively incremented and replaced by each new reference marker 14 recognised during the unwinding of the web 1. In normal time, the web 1 continues its advance through the longitudinal cutting station 52 before coming out in the form of narrow webs having a width systematically corresponding to the width of the tracks 11, 12, 13. The processing unit 65, knowing the abscissa at which the next cross-cut 24, 25 will occur on each occasion, looks out for data sent to it by the measuring instrument 62 allowing for the number of reference markers 14 already encountered. At the desired moment, the processing unit sends a signal to the belt driving devices in stations 50, 52, 55 and gradually stops the printed reel 37 unwinding, so that the downstream cut 24 of the web 1 stops on reaching the transverse cutting device 53. Station 53 can simply comprise a cutting instrument such as a blade or edge, disposed perpendicular to the direction of motion of the web and cutting that track or those tracks 11, 12, 13 which are defective at the place chosen between two adjacent printing platens 5. The upstream of the web 1 will then be deflected towards reject reels 54 for storing those tracks of all web portions 23 which are to be withdrawn from the web 1. The number of reject reels 54 will of course depend directly on the number of tracks on the web. The upstream cut 25 is made in the same manner. It is then only necessary to restore the continuity of the tracks cut from the web 1 by joining the remaining upstream and downstream parts. The join can be made very easily with carefully-applied adhesive tape.

In addition to the direct advantages of the device according to the invention, it can also supply a stream of information of use for statistical purposes for discovering the variation in the quality of products with time, e.g. by supplying a production traceability report intended for the final customer or for internal use. The information can also be used for improved control of maintenance of the printing machines and for anticipating a defect through wear before the wear becomes excessive. As a result, some parts of the machine can advantageously be replaced on time before beginning the printing cycle, thus avoiding maintenance work which is very undesirable during printing. Finally, at a more commercial quality level, the device can also, e.g. by supplying a certificate, confirm and guarantee the minimum quality required by a customer with regard to the reels 56, 57, 58 supplied to him.

The description of the device according to the invention refers to supports in the form of reels and continuous webs, but of course these products may without difficulty be replaced by discontinuous elements in sheet form stored e.g. in a stack. Numerous other improvements may be made to the invention within the scope of the claims.

What is claimed is:

1. A device for processing printing defects detected in a printing machine which, in a first phase, delivers a printed product starting from a support which, once printed, comprises:

a number of reference markers attached at rigorously regular intervals;

a mosaic of patterns constituting packaging material disposed in one or more adjacent rows or tracks; and a plurality of printing defects which are detected during an advance of the support in a detection station for displaying and locating a position of each printing defect by using a Cartesian reference system applying to the support, wherein the detection station is connected to a database that is capable of simultaneously storing information relating to each detected printing defect;

the processing device is connected to the database in order, in a second phase, to process the stored information in order to evaluate the quality of overall printing of the printed product and, before cutting the support in a third phase, to define all those portions thereof which should be removed in order to improve the final quality of the printed product, wherein the information stored in the database is processed by a data-processing interface that connects the database to a first processing unit for monitoring, during the third phase, an advance of the support by acting on the means driving the support and for re-synchronizing the marking of printing defects via the reference markers attached during the first phase, and for extracting all necessary data from a second processing unit for stopping the support of the printed product in a cutting station at a level of a downstream cross-cut followed by an upstream cross-cut, the cuts defining a portion of the support which is to be cut out.

2. A device according to claim 1, wherein the portion of the support for cutting out is limited to corresponding portions of the tracks spoilt by printing defects.

3. A device according to claim 1, wherein the data-processing interface comprises:

the second processing unit connected to the database and to the first processing unit;

an input peripheral;

an output peripheral for displaying the entire printed product and all the printing defects spoiling the printed product and for delivering at least one production report; and a bank offering a choice of virtual filters for masking at least one detected defect via the output peripheral.

4. A device according to claim 3, wherein the choice of virtual filters is made on the basis of at least one exclusion criterion applied to the information stored in the database; and the virtual filters can be used, produced, destroyed and modified either manually via the input peripheral or automatically by the second processing unit after analysis of the information contained in the database.

5. A device according to claim 3, wherein the portion of the support which is to be cut out is defined by the downstream cross-cut and the upstream cross-cut as a result of a compromise between the number of printing defects remaining after application of the chosen virtual filter to the stored information, and the effect on the entire printed product of withdrawing the portion of the support.

6. A device according to claim 3, wherein the virtual filters comprise a list of alphanumeric instructions compatible with the information stored in the database and decodable by a data-processing system contained in the second processing unit; and a virtual filter can be obtained by combining a number of elementary virtual filters.

7. A device according to claim 1, wherein the information relating to each printing defect stored in the database, comprises:

at least the Cartesian co-ordinates of a position of the printing defect on the support;

a level of importance; and a type defined in accordance with an appearance of the printing defect.

8. A device according to claim 1, wherein the station for cutting off portions of the support comprises a cutting element controlled by the first processing unit.

9. A device according to claim 1, wherein the printed product is on a reel and/or in sheets; and the support is a continuous web and!or at least one sheet.

10. A device for processing printing defects in a printed product delivered from a printing station, the printed product being comprised of a support layer, a mosaic of patterns printed on the support layer, each pattern constituting a separately usable element of packaging material disposed in one or more adjacent tracks; the printed product further including a plurality of printing defects, the processing device being comprised of:

a defect detection station including:

an imaging device positioned to inspect the printed product as it moves along a travel path; and a first data processing unit which is programmed to:

generate data representing individual printing defects in the printed product from signals generated by the imaging device;

generate data representing the location of the printing defects in terms of a Cartesian reference system applying to the support layer; and record the generated printing defect data in a database that is capable of simultaneously storing data relating to all of the detected printing defects in the printed product;

a defect processing station comprising:

a second data processing unit programmed to be responsive to data representing all of the defects in the printed product stored in the data base and to at least one quality-defining criterion to evaluate the quality of overall printing of the printed product and, to generate finishing instructions for selecting those defective portions of the printed product to be removed to obtain a desired final quality level for the printed product; and a device that executes the finishing instructions generated by the second data processing unit.

11. A device according to claim 10, wherein:

the detection station further includes a device that applies reference markers to the printed product at rigorously regular intervals;

the defect processing station includes:

a first detection unit that generates position signals representative of the passage of the printed product through the defect processing station and;

a second detection device that generates synchronizing signals in response to detection of the reference markers; and the second data processing unit is responsive to the position signals and the synchronizing signals to establish a succession of origins for a Cartesian reference system for the support layer, and to locate the positions of the defects in the printed product stored in the data base relative to the succession of origins.

12. A device according to claim 10, further including a mechanism that transports the printed product through the defect processing station after it has been inspected at the defect detection station; and wherein:

the device for executing the finishing instructions includes a first cutting device for performing a cut across the support layer transverse to the direction of motion thereof through the defect processing station; and the finishing instructions include data locating positions at which the transport mechanism is to be stopped, and commands to operate the cutting device to perform cuts across the printed product downstream and upstream of a printing defect which has been selected to be cut out.

13. A device according to claim 12, wherein the device for executing the finishing instructions further includes a second cutting device upstream of the first cutting device that performs a cut along the support layer in the direction of motion thereof through the defect processing station, thereby to created a plurality of separate printed products corresponding to each of the tracks.

14. A device according to claim 10, wherein:

the defect processing station further includes an interface unit which is comprised of:
a third data processing unit;
a data storage unit;
an input peripheral unit; and
an output peripheral unit, the third data processing unit is programmed to:
access the printing defect database and a plurality of virtual filters stored in the data storage unit;
generate and display a representation of the entire printed product and all the printing defects therein on the output peripheral unit;
deliver at least one production report;
respond to selection of one of the virtual filters to mask at least one of the printing defects in a display on the output peripheral unit; and
deliver data to the second data processing unit which is generated using the selected virtual filter.

15. A device according to claim 14, wherein the virtual filters respectively correspond to quality-defining criteria by which defects are specified in the finishing instructions for removal from the printed product.

16. A device according to claim 14, wherein the virtual filters can be used, produced, destroyed and modified either manually via the input peripheral unit or automatically by the third data processing unit after analysis of the information contained in the database.

17. A device according to claim 14, wherein the defects specified in the finishing instructions for removal from the printed product are determined as a result of a compromise between the number of printing defects remaining after application of the selected virtual filter to the stored information, and the effect on the entire printed product of removing the selected defects.

18. A device according to claim 14, wherein the virtual filters comprise a list of alphanumeric instructions compatible with the information stored in the database and decodable by the second data processing unit; and a virtual filter can be obtained by combining a number of elementary virtual filters.

19. A device according to claim 10, wherein the information relating to each printing defect stored in the database comprises:

at least the Cartesian co-ordinates of a position of the printing defect on the support;

a level of importance; and a type defined in accordance with an appearance of the printing defect.

20. A device according to claim 10, wherein the printed product is on a reel and/or in sheets; and the support is a continuous web and/or at least one sheet.

* * * * *